US009561536B2

(12) United States Patent
Bota

(10) Patent No.: US 9,561,536 B2
(45) Date of Patent: Feb. 7, 2017

(54) APPARATUS AND METHOD FOR PRODUCTION OF ADJUSTABLE DUCT MEMBER

(71) Applicant: Cleveland Tool & Machine, Inc., Brook Park, OH (US)

(72) Inventor: Victor Bota, Brooklyn, OH (US)

(73) Assignee: CLEVELAND TOOL & MACHINE, INC., Brook Park, OH (US)

( * ) Notice: Subject to any disclaimer, the term of this patent is extended or adjusted under 35 U.S.C. 154(b) by 494 days.

(21) Appl. No.: 13/835,681

(22) Filed: Mar. 15, 2013

(65) Prior Publication Data

US 2014/0259601 A1 Sep. 18, 2014

(51) Int. Cl.

| | |
|---|---|
| ***B23P 17/00*** | (2006.01) |
| ***B23P 11/00*** | (2006.01) |
| ***B21D 39/02*** | (2006.01) |
| ***B23P 23/00*** | (2006.01) |
| ***B23Q 15/00*** | (2006.01) |

(Continued)

(52) U.S. Cl.

CPC ..... *B21D 51/10* (2013.01); *B21D 39/02* (2013.01); *B21D 51/04* (2013.01); *B21D 5/01* (2013.01); *B21D 53/06* (2013.01); *Y10T 29/4935* (2015.01); *Y10T 29/49435* (2015.01); *Y10T 29/49796* (2015.01); *Y10T 29/5177* (2015.01)

(58) Field of Classification Search

CPC ..... Y10T 29/49796; Y10T 29/5177; Y10T 29/49437; Y10T 29/4935; Y10T 29/49444; Y10T 29/5199; Y10T 29/5185; Y10T 29/49428; Y10T 29/49435; Y10T 29/51; Y10T 29/11; B21C 37/28; B21D 5/01; B21D 7/06; B21D 9/08; B21D 51/10; B21D 53/06; B21D 39/02; B21D 51/04

USPC ..... 72/453.01, 452.4, 452.5, 452.6; 29/430, 29/564, 564.1, 564.2, 564.3, 709, 791, 796

See application file for complete search history.

(56) References Cited

U.S. PATENT DOCUMENTS

| | | | |
|---|---|---|---|
| 3,010,506 | A | 11/1961 | Bellatorre |
| 3,290,914 | A | 12/1966 | Vaill |

(Continued)

OTHER PUBLICATIONS

Iowa Precision, Collar-Matic and Colatch, http://www.iowaprecision.com/collar.html, Nov. 4, 2013, 3 pages, Iowa Precision Industries, Inc., 5480 Sixth Street SW, Cedar Rapids, Iowa 52404 U.S.A.

(Continued)

*Primary Examiner* — Essama Omgba
*Assistant Examiner* — Darrell C Ford
(74) *Attorney, Agent, or Firm* — Hahn Loeser + Parks LLP; Scott M. Oldham, Esq.

(57) ABSTRACT

An apparatus for forming and sealing an adjustable duct member for use in an air handling system. At least one work station accommodates a tapered work piece. A repositionable die is positioned relative to the work piece, and a cutting and forming assembly cooperates with the repositionable die to cut the work piece and form a coupling bead to reconnect the members together. A sealing assembly cooperates with the first repositioning die to seal the coupling bead in the first and second members. The work station includes an insertion channel having predetermined dimensions to accommodate at least a portion of the work piece. A clamping assembly is associated with the insertion channel to securely hold the tapered work piece at the predetermined position during the cutting and forming and sealing operations.

18 Claims, 11 Drawing Sheets

(51) Int. Cl.

| | |
|---|---|
| ***B21D 51/10*** | (2006.01) |
| ***B21D 51/04*** | (2006.01) |
| *B21D 5/01* | (2006.01) |
| *B21D 53/06* | (2006.01) |

(56) References Cited

U.S. PATENT DOCUMENTS

| | | | | | |
|---|---|---|---|---|---|
| 3,490,137 | A * | 1/1970 | Buck et al. | 29/437 | |
| 3,724,255 | A | 4/1973 | Molino | | |
| 3,728,059 | A | 4/1973 | de Putter | | |
| 3,815,394 | A | 6/1974 | Walker | | |
| 3,861,184 | A | 1/1975 | Knudson | | |
| 4,085,604 | A * | 4/1978 | Anderson | B21C 37/121 | 72/135 |
| 4,210,090 | A | 7/1980 | Stubbings | | |
| 4,244,202 | A * | 1/1981 | Anderson | B21C 37/124 | 72/132 |
| 4,399,679 | A | 8/1983 | King | | |
| 4,466,641 | A * | 8/1984 | Heilman et al. | 285/406 | |
| 4,709,755 | A * | 12/1987 | Gentry et al. | 165/160 | |
| 5,014,424 | A * | 5/1991 | Takasugi | 29/890.149 | |
| 6,047,584 | A | 4/2000 | Filippo | | |
| 6,105,227 | A * | 8/2000 | Bota | 29/33 K | |
| 6,363,764 | B1 | 4/2002 | Bota | | |
| 6,378,184 | B1 * | 4/2002 | Bota | 29/33 K | |
| 7,096,585 | B2 | 8/2006 | Bota | | |
| 7,797,805 | B2 * | 9/2010 | Rieck | 29/33 K | |
| 2004/0158986 | A1 | 8/2004 | Munoz | | |
| 2005/0028337 | A1 * | 2/2005 | Bota | 29/33 R | |
| 2006/0283010 | A1 * | 12/2006 | Rieck | 29/799 | |
| 2011/0121569 | A1 * | 5/2011 | Hermanson | 285/405 | |

OTHER PUBLICATIONS

Iowa Precision, "Adjust-A-Matic Automatic Elbow Machine-Operator's Manual", Sep. 19, 1994, 26 pages.

Iowa Precision, Ajust-A-Matic and Tube-Matic, http://www.iowaprecision.com/ajusta.html, Nov. 15, 2013, 3 pages, Iowa Precision Industries, Inc., 5480 Sixth Street SW, Cedar Rapids, Iowa 52404 U.S.A.

* cited by examiner

APPARATUS AND METHOD FOR PRODUCTION OF ADJUSTABLE DUCT MEMBER

TECHNICAL FIELD

The invention relates generally to an apparatus and method for production of adjustable duct members, and more particularly to forming adjustable duct members with sealed beads in order to increase the efficiency of the duct members.

BACKGROUND

In general, duct work is commonly used in forced air heating and air-conditioning systems for buildings and the like, with the duct work providing a distribution system to various areas of the building from a furnace and/or air-conditioning system. Coupling a round duct to the furnace or main trunk line is commonly provided via a top take off duct member which is positioned in association with the air handling equipment. The top take off provides the outlet for forced air to exit the trunk line or extended plenum for distribution to the registers. Typically, such a top take off comprises a cylindrical fitting associated with a length of cylindrical tubing which is coupled to an outlet opening in a high pressure plenum of the air handling system. The fitting is installed into and fixed in position with respect to the outlet opening in the wall of a trunk line or plenum. This take off duct can then be coupled into cylindrical duct work which extends to various portions of the building or the like. Depending on the particulars of an installation of an air handling system, it is many times problematic to efficiently couple into the top take off, as the position of the duct work may not correspond to the location of the top take off. Various fittings and interconnections are then necessary to couple the duct work to the air handling system, being a labor intensive and time-consuming process. Attempts to simplify connection of round duct work to a trunk line or plenum have included forming the top take off as an adjustable elbow which allows the orientation and position of the take off to be readily adjusted to simplify positioning and interconnection to the duct system. Such adjustable elbows typically will include three sections, each section being rotatable relative to the others. Each section in the take off is formed so as to be connected at an angular orientation relative to an adjacent section, whereupon relative rotation will vary the orientation of the outlet portion of the take off to simplify coupling into further duct work. Known adjustable take offs may be produced in different ways, but typically utilize a machine which a skilled operator uses for cutting and forming of each of the sections in the take off. Each of the sections may be adjustably coupled to an adjacent section by means of a bead coupling wherein a portion of each section is flared outwardly to engage a similar bead in an adjacent section, thereby locking the pieces together but allowing relative rotation therebetween. Known machines for producing and locking these sections together to form an adjustable take off are problematic, in that many of the stages of production of the sections in the take off are performed manually with a machine for cutting and beading of the take off sections. A skilled operator is therefore necessary to properly form each section and couple the sections together in a manner that they can be adjusted to one another. The difficulty of properly forming each section and connecting the sections together result in a high percentage of scrap as well as take offs which do not function well. More recently, automated take off machines have been produced which are designed to form straight take offs, wherein a cylindrical tube is cut into multiple pieces with the pieces being reassembled and locked together in an adjustable coupling. Although such apparatus is capable of forming a more uniform adjustable coupling between sections of the take off in a repeatable fashion, only straight take offs are able to be manufactured, with each section of the take off having a common diameter.

Other problems associated with these machines include the loss of air through the beads between the gores of the duct system. As air circulates through the duct system, air dissipates through the beads or seams that are between the gores, which in turn, causes a loss of energy and thus creates a less efficient system. Presently, no apparatus or methods exist for automated manufacture of adjustable ducts that are highly efficient with respect to the leakage that occurs at the beads or seams of the duct system.

SUMMARY

The invention is therefore directed to an apparatus for forming and sealing an adjustable duct member for use in an air handling system that includes at least one work station adapted to accommodate a tapered work piece, a repositionable die associated with the work station which is selectively positioned at a predetermined location relative to the work piece positioned in the work station, a cutting and forming assembly associated with the work station which cooperates with the repositionable die to selectively cut the work piece to form first and second members and to form a coupling bead in the first and second members which cooperate to reconnect the first and second members together at a predetermined position, a sealing assembly associated with the first work station which cooperates with the first repositioning die to selectively seal the coupling bead in the first and second members which cooperate to crimp the coupling bead together at the predetermined angle, wherein the work station includes an insertion channel having predetermined dimensions to accommodate at least a portion of the work piece, wherein a clamping assembly is associated with the insertion channel to securely hold the tapered work piece at the predetermined position during the cutting and forming and sealing operations, the clamping system comprising at least two movable clamping members positioned in an opposing manner about the insertion channel, and a control system for at least selective control of at least the clamping, the cutting and forming, and the sealing assemblies.

Another embodiment of the present invention includes a method of automated manufacturing an adjustable duct member includes the steps of: a) providing a tube of material having a tapered configuration and predetermined dimensional characteristics for forming the duct member, b) positioning of the tube in a work station at a first predetermined position relative to a cutting and forming assembly of the work station, c) clamping the tube in the first predetermined position to prevent movement during subsequent operations, d) cutting the tube at a first predetermined position to form first and second members, e) positioning the first and second members in overlapping relationship to one another, f) forming a bead in the first and second members at a position to cooperate with one another to allow relative rotation of the first and second members and interlock the first and second members, g) sealing the bead in the first and second members at the position to decrease an amount of air dissipated between the first and second members, h) repositioning of the tube in a work station at a second predetermined position relative to a cutting and forming assembly of the work station, i) clamping the tube in the second predetermined position to prevent movement during subsequent operations, j) cutting the tube at a second predetermined position to form first and second members, k) positioning the first and second members in overlapping relationship to one another, l) forming a bead in the first and second members at a predetermined position to cooperate with one another to allow relative rotation of the first and second members and interlock the first and second members, and m) sealing the bead in the first and second members at the predetermined position to decrease an amount of air dissipated between the first and second members.

Yet another embodiment of the present invention includes a forming and sealing air duct system kit that includes a pair of slidable plates with repositionable die members, wherein said repositionable die members are operatively attached and repositionable to said slidable plates, wherein said repositionable die members include at least one mounted cam, a pair of crimping plates, and a pair of at least one secondary hydraulic rams.

These and other features of the claimed invention, as well as details of illustrated embodiments thereof, will be more fully understood from the following description and drawings

DESCRIPTION OF EXAMPLES OF THE INVENTION

Figure 1:
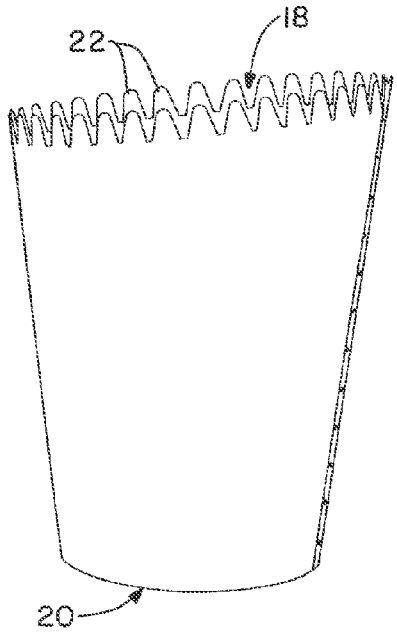
FIG.-1 (PRIOR ART)
FIG. 1 is a plan view of a tube which is manufactured into an adjustable duct according to the invention.
Figure 2:
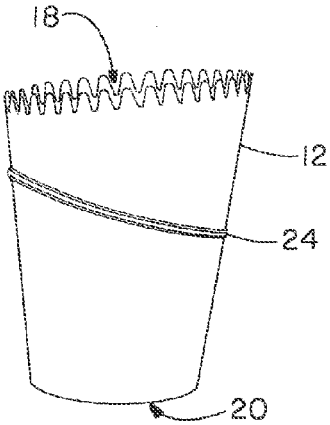
FIG.-2 (PRIOR ART)
FIG. 2 is a plan view of the tube as shown in FIG. 1, with a first adjustable bead formed therein between two gores of the tube.
Figure 3:
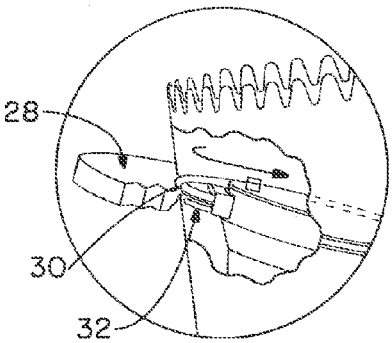
FIG.-3 (PRIOR ART)
FIG. 3 shows an enlarged partial cutaway view of the tube as shown in FIG. 2, showing a die and associated cutting and forming system for producing the two gores in the tube and forming the adjustable bead therebetween.
Figure 4:
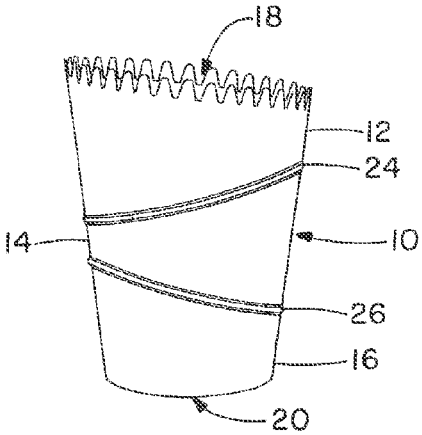
FIG.-4 (PRIOR ART)
FIG. 4 is a plan view of the tube as shown in FIG. 2, and further showing a second adjustable bead formed between gores of the tube.
Figure 5:
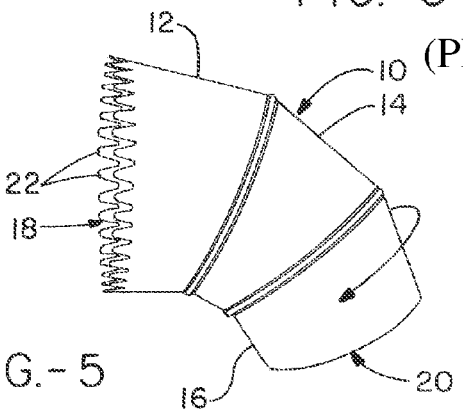
FIG.-5 (PRIOR ART)
FIG. 5 is a plan view of the duct member, showing adjustability of each gore of the duct member relative to one another.

Turning now to FIGS. 1-5, the invention is directed at producing an adjustable duct member such as shown in FIGS. 4 and 5, wherein the duct member 10 may include three sections or gores 12, 14, and 16. The duct member 10 further includes an inlet opening 18 and an outlet opening 20, being adapted to be coupled between other members in a duct system, or preferably as a top takeoff connected into a plenum associated with the air handling system. To facilitate connection of the duct member 10 in association with a plenum, inlet opening 18 may be provided with a plurality of tabs 22 which may be selectively bent into engagement with an inner wall of the plenum through an opening formed therein. The duct member 10 may include a taper from the inlet opening 18 to the outlet opening 20, such that each of the gores 12, 14 and 16 become progressively smaller. The tapering of the gores 12, 14 and 16 provide a significant increase in velocity of air passing through duct 10 from the plenum of the air handling system. Although the invention is described with reference to a tapered duct, wherein first and second work stations are preferably utilized, it should be recognized that the invention applies to non-tapered duct members also. The duct member 10 may be produced from a flat blank of material which is rolled such that opposed seams of the blank slightly overlap and are coupled to one another to form the tubular configuration. Coupling at the overlapping seams may be provided in any suitable manner, such as by riveting or the like. As an example, the tubular configuration of the formed blank of material may provide a starting work piece as shown in FIG. 1, which may then be operated on by the apparatus and methods of the invention. The work piece as shown in FIG. 1 is designed to have a predetermined configuration and dimensional characteristics for use in the apparatus and methods of the invention, but any suitable particular dimensional characteristics of the work piece can be accommodated. As an example, the tapered tube as shown in FIG. 1 may have an inlet opening 18 having a diameter of seven inches, while the outlet opening 20 has a diameter of 5.7 inches.

The apparatus and methods of the invention will take the work piece as shown in FIG. 1 and produce adjustable seams or beads 24 and 26 in the work piece to form the duct member 10 in the final preferred form as shown in FIGS. 4 and 5. To produce this configuration, a first adjustable seam 24 is produced at a predetermined position and orientation relative to the inlet and outlet openings 18 and 20. It is noted that in the desired configuration of the work piece as shown in FIG. 1, the inlet opening 18 is angled relative to the outlet opening 20, such that when the duct member 10 is installed in association with a plenum, the first gore 12 will be angled at 30° relative to the wall of the plenum. The first adjustable seam 24 produced in duct member 10 is thereafter preferably oriented at an angle of 15° relative to the plane of the outlet opening 20, and oriented in opposing relationship to the orientation of outlet opening 18. The second adjustable coupling bead 26 is thereafter preferably formed again at an angle of 15° relative to the plane of outlet opening 20 and in opposing relationship to adjustable coupling bead 24 as shown in FIG. 4. With this preferred configuration, the duct member 10 may be configured such that inlet and outlet openings 18 and 20 are coaxial as shown in FIG. 4, or by adjustment of gores 12, 14 and 16 relative to one another, at 90° to one another. The adjustment of gores 12, 14 and 16 relative to one another is shown in FIG. 5.

The coupling beads 24 and 26 formed in the duct member 10 are preferably formed by means of a cutting and forming system in conjunction with a die positioned about the member 10. As shown in FIG. 3, the apparatus of the invention includes a die, generally shown at 28 having a shaping section 30 formed on a portion of the die 28 adjacent the exterior surface of member 10. On the interior of the tube 10, a cutting and forming system generally designated 32 is provided to selectively cut and shape portions of the tube in cooperation with die 28 to form the coupling beads 24 and 26. The operation of the apparatus will be discussed in more detail as the description proceeds.

Figure 7:
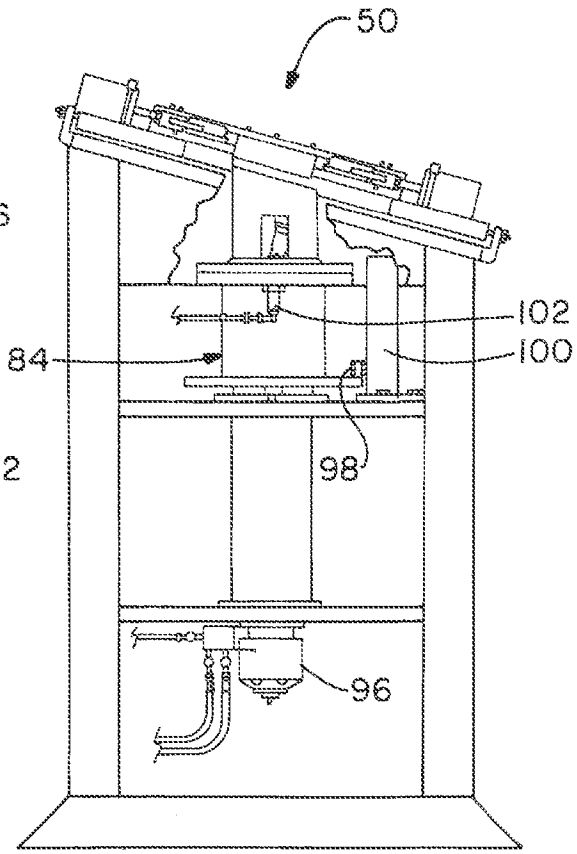
FIG.-7 (PRIOR ART)
FIG. 7 is a side view of the apparatus as shown in FIG. 6.
Figure 6:
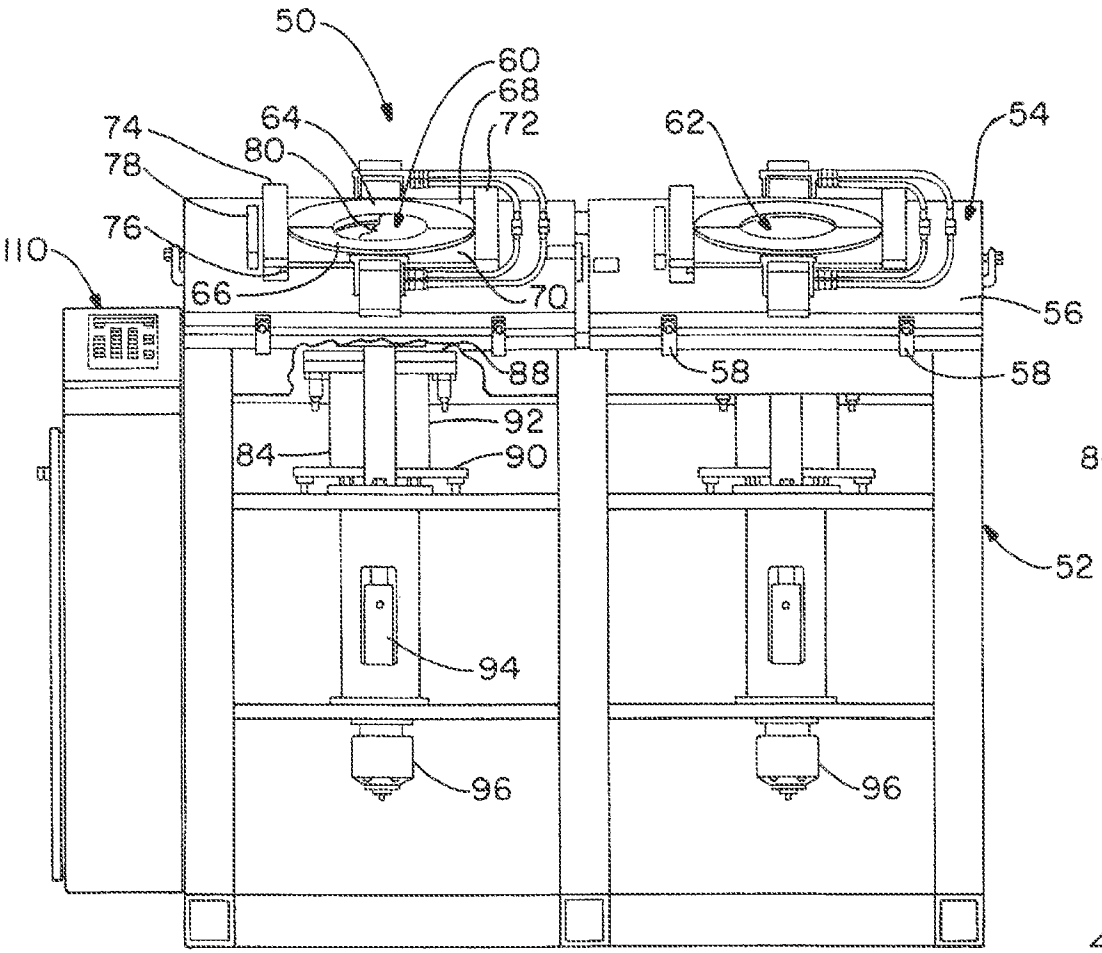
FIG.-6 (PRIOR ART)
FIG. 6 shows a plan view of an apparatus for forming an adjustable duct member according to the invention.
Figure 8:
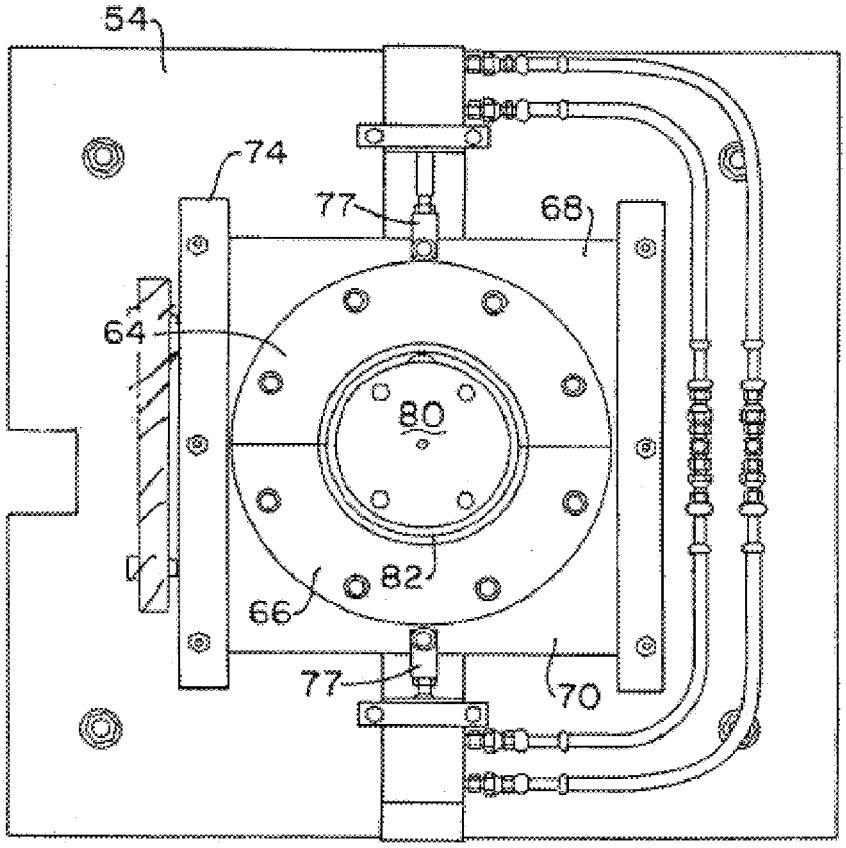
FIG. 8 is a top view of the apparatus as shown in FIG. 6.

Turning now to FIGS. 6-8, a preferred embodiment of the apparatus according to the invention is shown in more detail. The apparatus generally designated 50 includes a housing or frame construction 52 which supports various components of the apparatus. Housing or frame 52 includes an upper surface 54 which is preferably defined by a floating support plate 56 which is adjustably mounted to the frame 52. The upper support plate 56 is angled at a predetermined angle relative to horizontal or ultimately to the plane of the outlet opening 18 associated with the work piece (described previously in FIGS. 1-5), which is supported on a base plate provided as a part of an operating nest arrangement to be more fully described hereafter. Providing plate 56 with some adjustability allows an operator to adjust this predetermined angle to produce a predetermined component as desired. The plate 56 may be held in position by a plurality of support fasteners 58 or other suitable devices. The upper surface 54 of the apparatus 50 may include two work stations or nests generally designated 60 and 62, each of which is formed as a recess adapted to accept the work piece discussed in previous figures to perform the operations for cutting and forming the coupling beads between gores of the work piece as described. Alternatively, the apparatus of the invention could utilize only one work station in which multiple cutting and coupling bead forming steps could be performed to fabricate the desired adjustable duct member. The work station would provide the cutting and coupling bead forming steps in at least two predetermined locations, and with the tapered tube, would accommodate different diameters of the tube to perform these steps.

In the particular embodiment shown, each of the nests and associated components to perform those operations are substantially identical in many respects, except that the work piece is positioned differently in each nest 60 or 62 to form one or the other of the cutting and forming operations to produce the adjustable duct member of the invention. As shown in the figures, each nest 60 or 62 can include a die supported on the upper surface, which in the preferred embodiment may be comprised of first and second semicircular members 64 and 66 which are positioned on opposed sides of the nests 60 or 62. The die members 64 and 66 are positioned immediately adjacent the nest 60 or 62 in operation, but preferably may be moved into a nonoperational position away from the nest 60 or 62 when desired in a manufacturing cycle. Therefore, each of the die member 64 and 66 may be supported in association with a slidable plate 68 and 70 which is supported in sliding engagement with support blocks 72 and 74 in a channel or slot 76. The support block 74 may be adjusted relative to the plates 68 and 70 for smooth slidable operation of the plates within slot 76. Each of the plates 68 and 70 may be moveable toward and away from the nest 60 or 62 by means of a hydraulic ram 77 or other suitable mechanism. Within the nest 60 or 62, a cutting and forming system 80 is provided in the recessed portion of the nest 60 or 62. Between the die members 64 and 66 and the cutting and forming system 80, a circular channel 82 is formed by the recess of the nest 60 or 62, the channel 82 being dimensioned to accept the work piece as shown in FIG. 1, with the work piece extending into the channel 82 to a predetermined depth. Associated with the nest 60 or 62 is a at the bottom of channel 82 on which the work piece is supported within the nest 60 or 62 at the predetermined position. As will be hereinafter described in more detail, the base plate is formed in association with a moveable platen 84 which is operated on by a pair of hydraulic rams 86 or other suitable mechanism. Providing hydraulic rams 86 or other suitable mechanism on opposed sides of the moveable platen 84 ensures proper operation to selectively move platen 84 upwardly or downwardly with respect to the housing and other components of the apparatus 50. The moveable platen 84 preferably carries at its upper end the base plate 88, with a drive plate 90 at the bottom end thereof. The central portion 92 of platen 84 is a cylindrical portion extending between plates 88 and 90. The plates 88 and 90 each have apertures coinciding with the cylindrical portion 92 to define a hollow interior through which a drive shaft arrangement 94 is positioned. The drive shaft system 94 is coupled to be driven by a hydraulic motor 96 supported in association with housing 52. The platen assembly 84 is moveable about the drive shaft assembly 94 upwardly and downwardly to selectively position a work piece relative to the die members 64 and 66 and the cutting and forming system 80. The platen assembly 84 may further include a guide mechanism 98, which will prevent rotation of the platen assembly 84 by any lateral forces which may be imposed thereon. The guide mechanism 98 may simply comprise a guide pin positioned within a track or channel member 100 supported in association with housing 52. Other suitable mechanisms may also be utilized, or no guide mechanism may be necessary.

Figure 14:
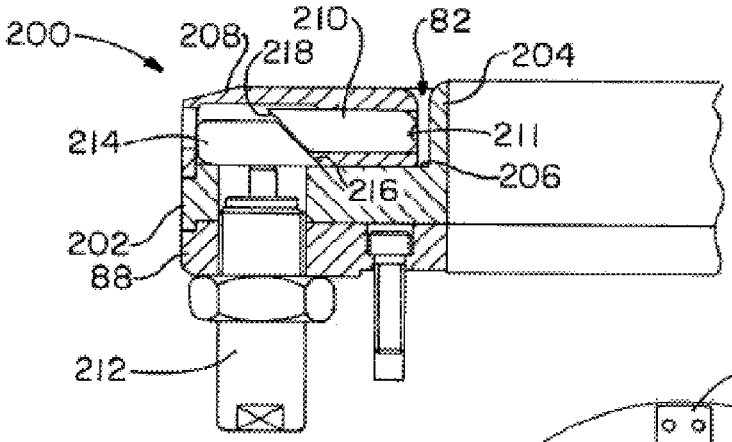
FIG. 14 shows a partial cross-sectional view of the clamping assembly ring of FIG. 13.
Figure 13:
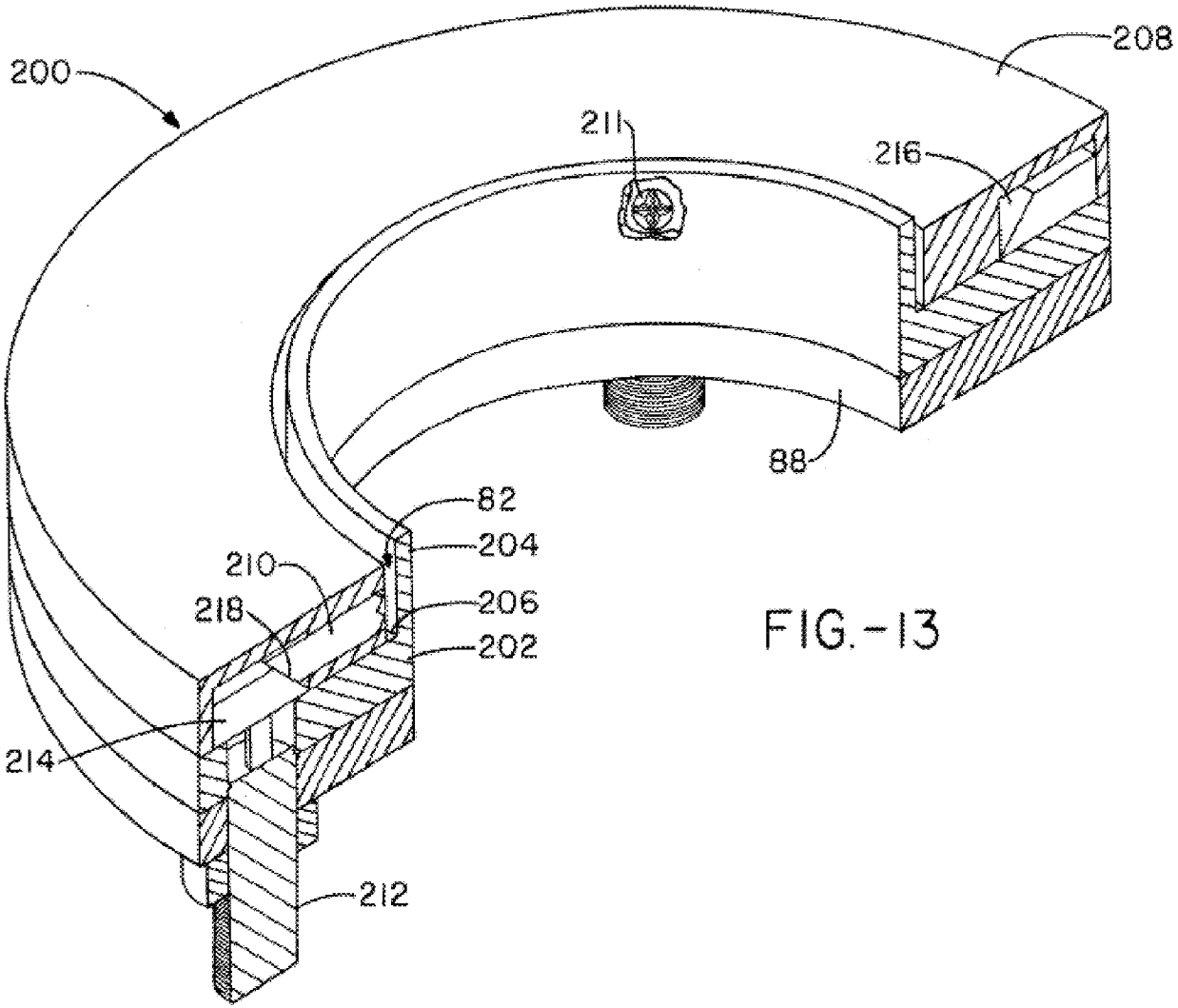
FIG. 13 shows a partial cross-sectional perspective view of the clamping assembly ring in accordance with the present invention.

Referring now to FIGS. 13 and 14, the base plate 88 has a clamp assembly 200 mounted thereto comprising a base ring 202 having an upwardly turned tubular extension 204 along and interior diameter thereof. The interior diameter of extension 204 provides clearance for support block 142 which will be discussed in detail below. The outer diameter of extension 204 is of a predetermined size such that either the inlet end 18 or outlet end 20 of duct member 10 fits over the extension 204 and is positioned a predetermined depth by contact with the top surface 206 of base ring 202. Clamp assembly 200 also comprises a clamp ring 208 mounted and affixed to the top surface 206 of base ring 202. Clamp ring 208 has an interior diameter larger than the outer diameter of extension 204 such that a channel 82 is formed allowing clearance for the insertion of one of either the inlet end 18 or outlet end 20 of duct member 10. The clamp ring 208 comprises one or more clamp members 210 which are hydraulically or electrically actuated by one or more corresponding pistons 212. The clamp members 210 are generally oriented perpendicular to extension 204 and parallel to the top surface 206 of base ring 202. The clamp members 210 are generally shown herein as cylindrical members having a gripping irregular surface 211 on one end thereof. As shown in FIGS. 13 and 14, the piston 212 is connected to a piston ring 214 which moves upward and downward within clamp ring 208. The piston ring 214 has an angled surface 216 along and interior diameter surface thereof. The angled surface 216 engages an angled surface 218 on clamp member 210, on an end opposite the gripping irregular surface 211, such that upward movement of piston ring 214 forces the clamp member 210 inward against the wall of duct member 10, and against extension 204. The duct member 10 is securely held in place by the gripping irregular surface 211 as cutting and forming operations are perform thereon as will be discussed in detail below. The gripping pressure can be increased by adding additional pistons/gripping members.

Figure 15:
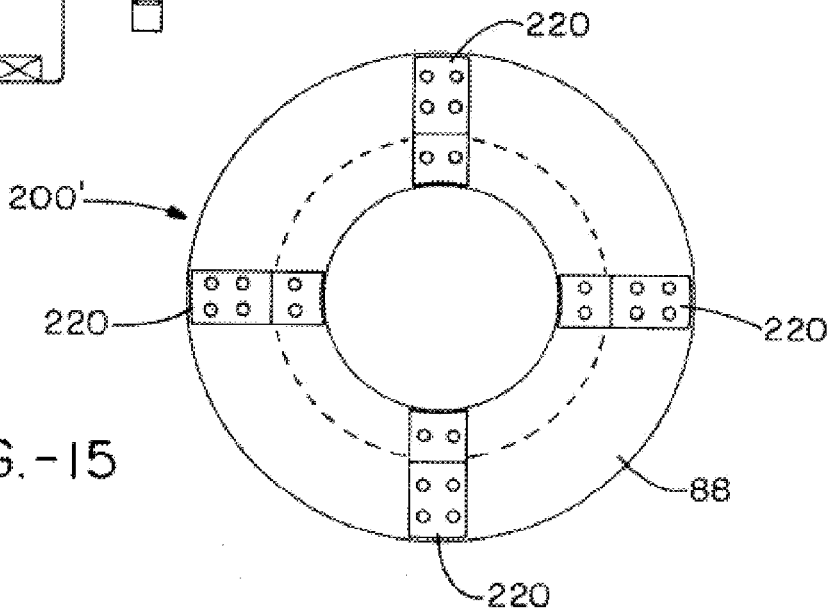
FIG. 15 shows top plan view of an alternate embodiment of the clamping assembly of the present invention.
Figure 16:
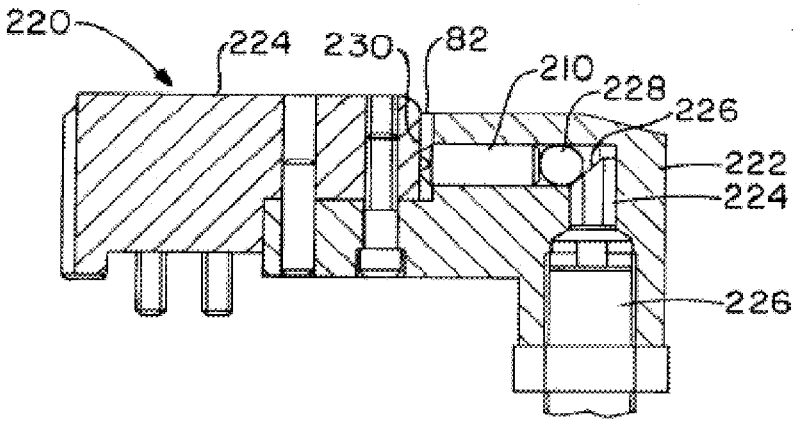
FIG. 16 shows a cross-sectional view of an individual clamp assembly of the type shown in FIG. 15.
Figure 17:
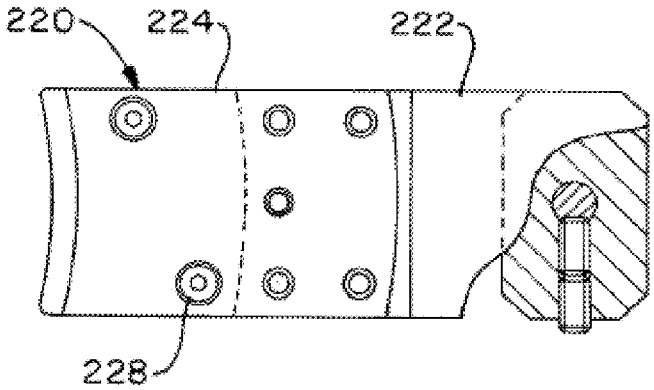
FIG. 17 shows a top plan view of an individual clamp assembly of the type shown in FIG. 15.

In an alternate embodiment, especially with larger diameter duct members 10 the clamp assembly 200' comprises one or more clamping devices 220. The clamping devices 220 are mounted on base plate 88 in at least opposing relationship, such as at predetermined angular intervals as is shown in FIG. 15. Although the clamping devices 220 may have slightly different configurations for different size of duct members 10, each device 220 comprises a backing surface member 222, a body member 224, and a piston 226 for engaging a clamp member 210. Referring now to FIG. 16 and FIG. 17, a representative clamping device 220 is shown. FIG. 17 shows a top plan view of a clamping device 220. The device 220 is mounted to the base plate by one or more set screws 228 shown through the backing surface member 222. The backing surface member 222 is fixably attached to the body member 224 as shown in FIG. 16, forming a clearance 82. The wall 230 of the backing surface member 222 forming clearance 82 is curved at a predetermined radius generally corresponding to that of the duct member 10. The clamping devices 220 each comprise a piston 222 having a piston rod 224 extending therefrom and having an angled surface 226 at an end thereof. The angled surface 226 of piston rod 224 engages a ball 228 and forces of the ball 228 against clamp member 210. As in the previous embodiment, clamp member 210 is oriented perpendicular to wall 230 and parallel to base plate 88. The clamp member 210 engages the wall of duct member 10 and clamps the duct member firmly securely against wall 230, in a manner preventing rotation during the cutting and forming operations. The gripping pressure can be increased by adding additional clamp devices 220.

The clamp devices 220 are quickly and easily removed and replaced on the base plate with clamp devices designed to be used for duct members 10 having a different diameter. It is contemplated that some changeovers can be accomplished by rotating the base plate to use a second set of clamping devices already attached to the base plate at intermediate angles between the first set of clamping devices.

Clamp assemblies 200, 200' are provided as embodiment of the present invention to effectively clamp the duct member 10, such as a tapered top take off, and prevent movement or rotation during the cutting and forming operations which will be described in greater detail below. These embodiments are not intended to limit the scope of a particular version of a clamp assembly as it is contemplated that modifications and adaptations of the embodiments shown are included in the scope of the present invention.

The cutting and forming system 80 associated with each of the nests 60 or 62 is preferably designed to simultaneously cut, pre-form and finish form the coupling beads which reconnect and lock together cut portions or gores of the work piece as previously described. In general, once the work piece is positioned in nest 60 or 62, operation of the cutting and forming system 80 will initially cut the work piece along a predetermined angular position defined by the angle of the upper surface 54 relative to the work piece positioned within nest 60 or 62. In desired operation, the cut performed by the cutting and forming system 80 is oriented at 15.degree. relative to the outlet opening of the work piece as previously described, and at a predetermined position or distance from the outlet opening 20. Once the work piece is cut by the cutting and forming system 80, the coupling bead must then be formed in the respective gores of the work piece adjacent the cut line and the gores interconnected via the formed coupling bead. To accomplish this, in the preferred operation and with reference to FIG. 4 showing the finished duct member 10, the work piece is positioned in nest 60 in a first stage of operation, to form the cut and coupled bead connection 26 between gores 14 and 16 in duct member 10. In the preferred operation, the cutting and forming system 80 will simultaneously pre-form the bottom edge of gore 14 and the top edge of gore 16 with a slight inward taper so that gore 16 can be moved into overlapping relationship with gore 14. The beads formed in the gores 14 and 16 may also be pre-formed for thereafter forming the coupled bead 26 which interconnects these gores so that they cannot be separated, but allows relative rotation therebetween. Once the gores 14 and 16 are overlapped, the beads in each are finally formed in conjunction with one another to form coupled bead 26, by means of the cutting and forming system 80 so as to cooperate with one another in this fashion. Preferably, the material from which the work piece is formed is of significant structural integrity whereby the beads formed in each of the gores 14 and 16 are relatively deep and consistently formed to facilitate maintaining the connection between these gores while ensuring smooth and easy relative rotation between the gores.

Subsequent to formation of the coupling bead 26, the work piece is then removed from nest 60 and positioned in nest 62 to form the second cut and coupled bead 24 between gores 12 and 14. The work piece is rotated 180° before being positioned in nest 62 to form the opposing 15° moveable seam 24. If a single work station is used to perform both operations, a mechanism to rotate the work piece may be provided. In the described embodiment, the work piece is positioned within the recess formed by nest 62 to a deeper extent so as to position the coupled bead 24 at a predetermined position relative to the other gores of duct member 10. A similar operation is then performed by the cutting and forming assembly 80, whereby the work piece is cut forming gores 12 and 14, the edges of the gores 12 and 14 are pre-formed so as to ease positioning in slightly overlapping relationship and the cooperating beads may be pre-formed in each of the gores. Once the gores are repositioned in overlapping relationship, the beads are finally formed in conjunction with one another to reconnect the gores in locked relationship while allowing relative rotation therebetween. As should be recognized, because the work piece from which the duct member is made is preferably formed as a tapered tube, the size of the nest 62, die member 64 and 66 and cutting and forming assembly 80 are differently sized from those components in nest 60 to accommodate the greater diameter at the location of coupled bead 24. In this way, the apparatus 50 can be configured to accommodate any size tube, and these components can also be interchangeable for varying the size of duct member produced thereby. Additionally, it may be desirable to have a longer throat portion or gore 12 associated with the duct member 10, and again the nests 60 and 62 as well as associated die members and cutting and forming systems 80 would all be designed to accommodate such a configuration.

Also in the preferred embodiment, as cutting and forming operations are performed by the assembly 80, there may be a lubricating system generally designated 102 which will selectively apply lubrication to the interior of the work piece at the location of the cutting or forming operations as desired. The typical prior art lubrication systems consist of merely of a copper tube which is pinched with pliers to control the pattern of the lube spray. The lubrication system 102 of the present invention uses a lubrication spray head 102 which is typically removable and replaceable. The lubrication spray head 102 is typically made of brass and has a precise hole for proper delivery of the lubrication spray. Any suitable lubrication system may be used in this regard. In addition, the apparatus 50 preferably includes a control system generally designated 110, which may be any suitable system such as a microprocessor or PLC based system, to selectively perform the various operations and steps to produce the duct member 10 according to the methods of the invention. Preferably, control system 110 can be designed to automatically perform various operations in a manufacturing sequence to produce a particular type of duct member 10. Each different type of duct member will effectively have a process sequence recipe that can be simply recalled using the control system 110, with subsequent automated performance of each step in the manufacture of the duct member 10. In this way, an unskilled operator can simply recall a particular recipe for the type of duct member to be produced, alleviating the necessity for a skilled operator and simplifying the manufacturing process. The functions controlled by the control system 110 will be described in more detail with reference to a preferred hydraulic circuit which controls various functions in the apparatus 50.

Figure 9:
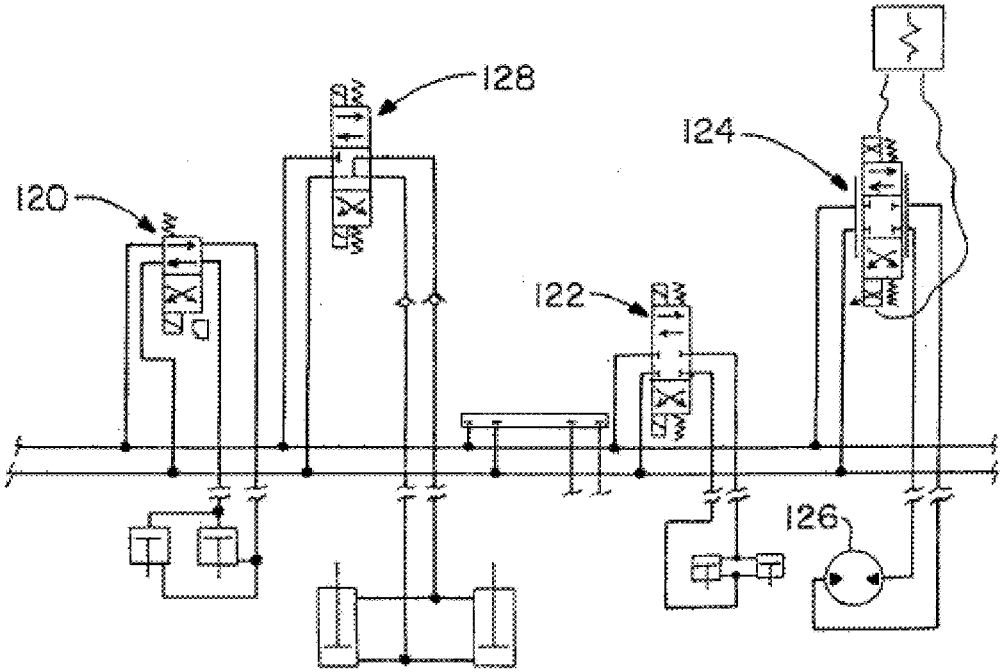
FIG. 9 is a schematic diagram of the control system associated with each nest in the apparatus of the invention.

Turning to FIG. 9, the various control functions of the preferred embodiment are shown schematically for one of the nests 60 or 62 and the associated functions performed when the work piece is inserted therein. It should be understood that the control functions as described in FIG. 9 are similar for each of the nests 60 or 62 and the associated components, and therefore only one of the hydraulic control systems is shown for clarity. In FIG. 9, a hydraulic control circuit is shown, although other types of controls are contemplated in the invention, and the invention is not limited to the control of various functions by hydraulic mechanisms. Corresponding to the operation of the apparatus 50 as previously described, and in the preferred embodiment, the work piece once positioned in a nest 60 or 62 is preferably clamped in position to ensure proper positioning with respect to the cutting and forming assembly.

Within the recess or channel 82 of nest 60 or 62, a work piece retaining mechanism is provided, the preferred embodiment to be described hereafter. In general, the work piece retaining mechanism may be a tube clamp which is engaged with the bottom of the work piece positioned within recess 82, but any suitable clamping mechanism may be utilized. Operation of the clamp may be controlled hydraulically by means of a hydraulic circuit including valve 120 operated by the control system 110 previously described. Once the work piece is properly positioned and clamped, the cutting and forming operation may begin, wherein it may be desirable to initially lube the surfaces of the work piece prior to cutting and forming. A lube mechanism controlled by a hydraulic circuit and associated valve 122. The cutting and forming operation performed by the cutting and forming assembly 80 is then initiated by means of a hydraulic circuit component 124, and preferably includes a proportional valve used to control the hydraulic motor 126 to extend the life of the hydraulic motor by avoiding excessive wear caused by repeatedly starting and stopping the motor during a manufacturing cycle or in distinct cycles. In association with the cutting and forming operation, the control system 110 further controls a hydraulic circuit and associated valve 128 to operate the hydraulic cylinders engaging the platen assembly on which the work piece is supported. The position of the work piece relative to the cutting and forming assembly is thus varied to form the cooperative bead coupling as previously described by up and down movement of the platen assembly. Other control functions may also be performed by the control system as desired.

Figure 10:
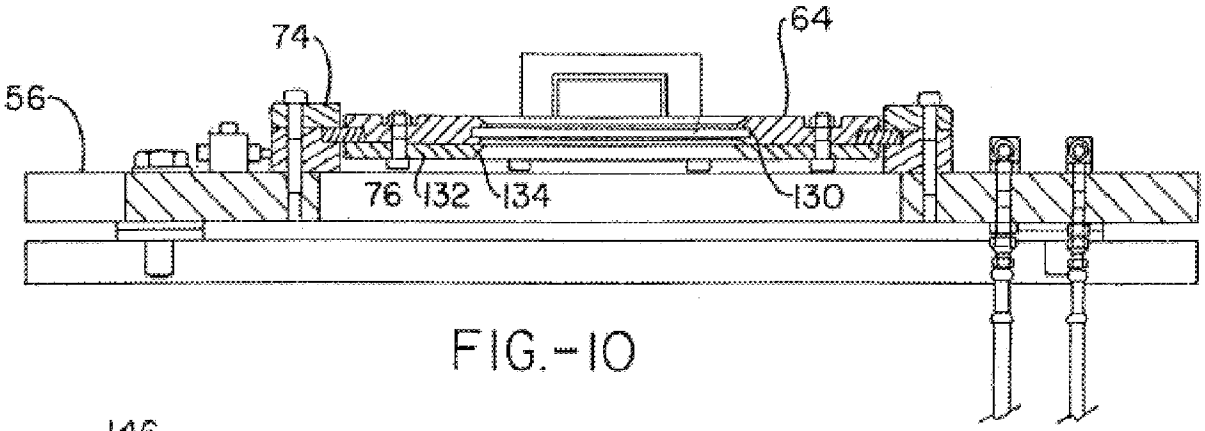
FIG. 10 shows an enlarged partial sectional view of the upper plate and die assembly.

Turning now to FIG. 10, the top plate assembly and associated die members and cutting and forming head are shown in more detail. The die members 64 and 66 as previously described are designed to cooperate with one another to form when positioned adjacent the work piece a stationary form into which material of the work piece is pushed by the cutting and forming system 80. Preferably the die members 64 and 66 are formed to include a recess, which will cooperate with a portion of the forming system 80 to generate an outwardly directed bead in the work piece of substantial depth. It is pointed out that, die members 64 and 66 also perform a clamping function in addition to the forming function of the die. This enables both sections 12, 14, 16 to be properly secured during an after the cutting and forming operation. Below the forming section of the die, a separate plate 132 may be provided with an outwardly extending knife edge 134 which is designed in cooperation with the cutting and forming assembly to cut the work piece at the desired position. The cutting plate, or ring 132, is fixably attached to the die members 64 and 66. Providing the knife as a separate member 132 facilitates maintenance of the apparatus, as it is possible for the knife or knife edge to become damaged, simplifying replacement of the plate 132 without impact on the forming section of the die formed by die member 64 and 66. The particular shape of the forming portion or knife portion of the die may be modified to produce a desired coupling bead configuration other than that shown in the preferred embodiment.

Figure 12:
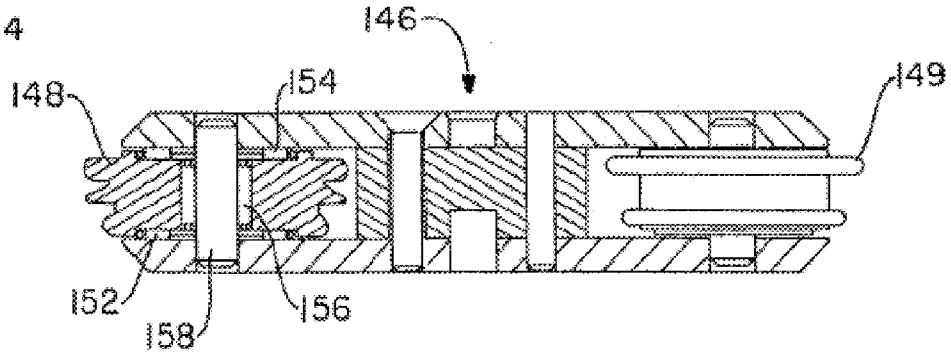
FIG. 12 shows a partial sectional view of the roller assembly associated with the assembly shown in FIG. 11.
Figure 11:
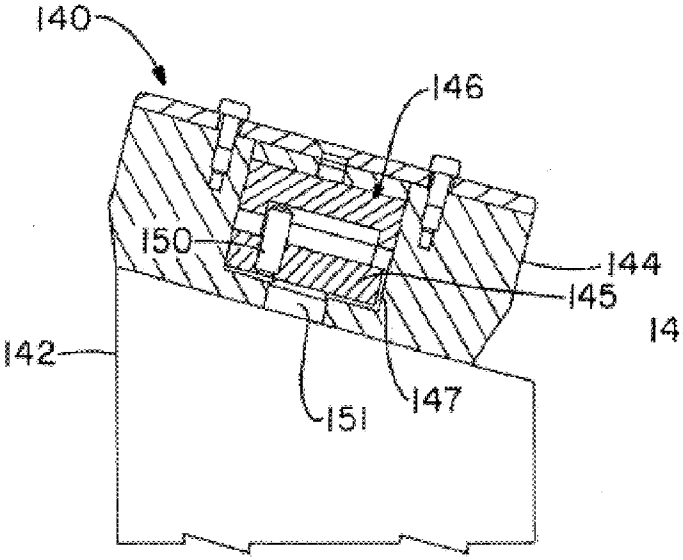
FIG. 11 shows a partial sectional view of the cutting and forming assembly.
Figure 18:
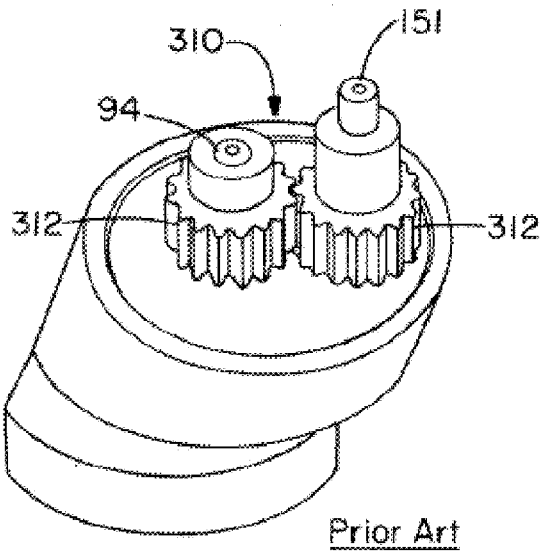
FIG. 18 shows a perspective view of a prior art drive shaft and eccentric shaft.
Figure 19:
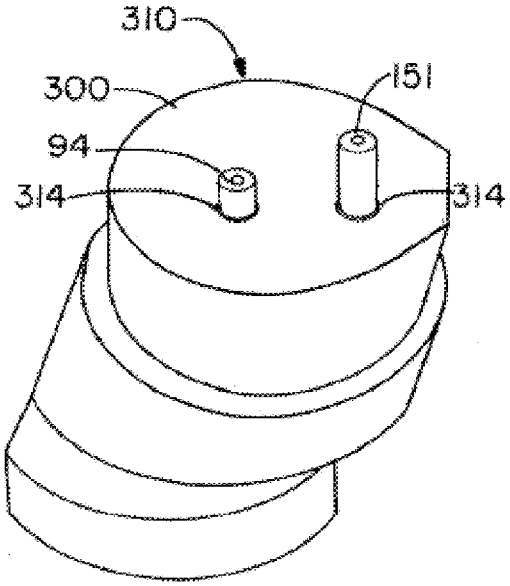
FIG. 19 shows a perspective view of the shaft shown in FIG. 18 incorporating and embodiment of the present invention comprising a protective shield cover.

FIGS. 11 and 12 refer to a preferred embodiment of the cutting and forming assembly 80 of the invention, although other mechanisms to preform the functions of assembly 80 would occur to those skilled in the art. In FIG. 11, the cutting and forming assembly may comprise a head portion 140 including a supporting block 142 carrying a rotating working head 144 shown in section. The drive shaft 94 driven by motor 96 is positioned to extend through the support block 142 and is coupled to the working head 144 for selective rotation thereof. The working head 144 includes a moveable slide block 146 mounted within a slot 147, having a cutting wheel 148 at one end thereof and a beading wheel 149 on the other end. The slide block 146 is moved back and forth to provide cutting and beading steps successively, with each of the wheels 148 and 149 being successively exposed to perform these operations as the head 144 rotates. In the present embodiment, it has been found that enlarging the width of the beading and cutting wheels allows a deeper cut and better bead formation enabling the sections 12, 14, 16 of the duct member 10 to have a better connection, facilitating proper rotation with respect to one another. The back and forth motion of the slide block 146 within slot 147 is created by an eccentric drive shaft 151 mounted in the center of the working head 144. The eccentric shaft 151 includes an eccentric drive head 145. This shaft is driven through an appropriate gear assembly 310 to couple rotation of the drive shaft 94 to the eccentric drive shaft 151 as best shown in FIG. 18. FIG. 18 shows one end of drive shaft 94 drivingly coupled to eccentric drive shaft 151 in a prior art manner wherein the end of drive shaft 94 is unsupported and the gears 312 are unprotected from dirt and other contaminants common to the environment of machine operation. In one embodiment of the present invention, this gear assembly 310 connection is improved by providing a protective cover 300 as best shown in FIG. 19. The protective cover 300 prevents dirt and contamination of the gears 312 thereby increasing the life of the gear assembly 310. The protective cover 300 can also provide a housing for bearings 314 for the drive shaft 94 and the eccentric drive shaft 151 which provides additional support, maintains alignment of the gear assembly, and also increases the life of the gear assembly 310. Returning to FIGS. 11 and 12, an off-center pin 150 associated with the eccentric drive head 145 is engaged in a slot in the bottom of the slide block 146 which moves the slide block 146 within slot 147 so as to selectively expose one of the wheels 148 or 149 as the head 144 rotates. The slide block 144 is initially centered within slot 147, and the cutting wheel 148 is then moved out into engagement with the interior of the work piece, and cooperates with the knife edge on the stationary die member as previously described to cut the work piece. The slide block 146 then moves to expose the beading wheel 149 after the cut pieces of the tube are positioned in overlapping relationship. In cooperation with the stationary die member, the bead coupling is formed. The operation of the head 144 may be similar to that provided in a machine produced by Iowa Precision Industries referred to as an AEM Gearhead Machine.

Figure 11A:
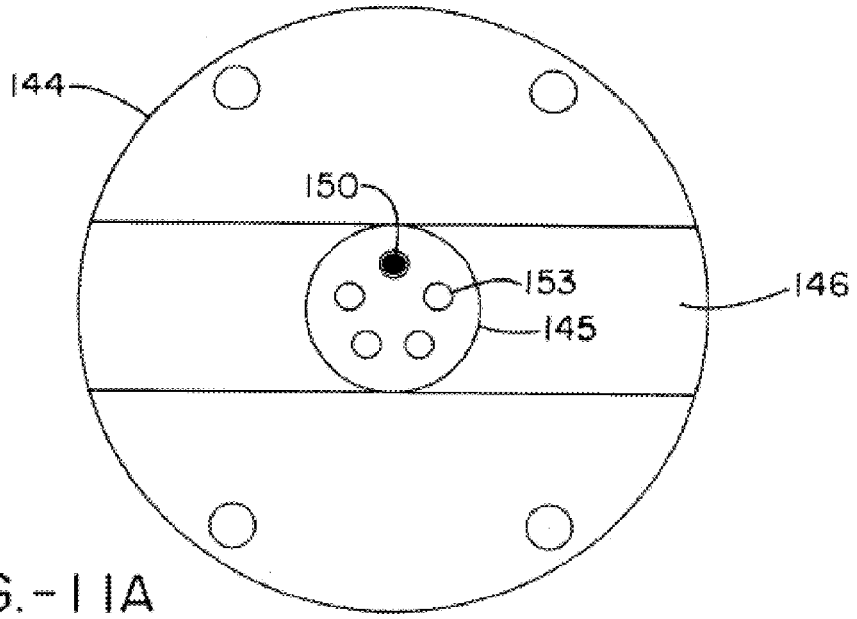
FIG. 11A shows a partial top plan view of the cutting and forming assembly shown in FIG. 11.

Referring now to FIG. 11A, it is also desired in the preferred embodiment that the mounting of the slide block 146 within the working head 144 is adjustable by repositioning the eccentric pin 150 in a different mounting hole 153 within the eccentric drive head 145. The different mounting holes 153 are located at slightly different distances away from the center of the eccentric shaft drive head 145. This permits the range of motion, or stroke, of the slide block 146 to be slightly increased or decreased by using a different eccentric pin mounting hole 153 location. Allowing adjustment of the eccentric drive head 145 enables the user to fine tune the coupled bead formation for the particular work pieces being used. The fine-tuning is particularly helpful when using differing material thicknesses, different materials, aluminum coated materials, painted materials, or other variables in the work pieces or operation. The adjustment allows more or less material into the overlap such that the cutting and forming process can be optimized resulting in an increase in the precision of the formation of the coupling beads 24, 26. The increase in precision results in an increase in the speed of the operation such that multiple passes are not required, thus allowing a decrease in production cycle times.

Also in the preferred embodiment, the wheels 148 and 149 are mounted in the slide block 144 with bearing assemblies 152 and 154 above and below the wheels and bearings 156 about a center post 158 to ensure proper alignment and operation of the wheels. Using this construction in association with the stationary die member provides very high precision in the cutting and forming of the coupling beads for smooth rotation between the gores of the duct member.

Referring to FIGS. 20 through 26, a sealing system 400 is shown that may include a repositionable die member 420 and 422, a slidable plate 430 and 432, and a crimping plate 410 and 412. As in the previous embodiments of the present invention and shown in the previous figures, each of nests 60 or 62 can include a die supported on the upper surface, which in another embodiment may be comprised of the first and second semi-circular repositionable member 420 and 422, which are positioned on opposed sides of the nests 60 or 62. The repositionable die members 420 and 422 are positioned immediately adjacent the nest 60 or 62 in operation, but may also be moved into a non-operational position away from the nest 60 or 62 when desired in a manufacturing cycle. Therefore, each of the repositionable die member 420 and 422 may be supported in association with the slidable plate 430 and 432 which is supported in sliding engagement with support blocks 72 and 74 in a channel or slot 76. The support blocks 72 and 74 may be adjusted relative to the slidable plates 430 and 432 for smooth slidable operation of the plates 430 and 432 within the slot 76. Each of the plates 430 and 432 may be moveable toward and away from the nest 60 or 62 by means of a hydraulic ram 77 or other suitable mechanism. Within the nest 60 or 62, a cutting and forming system 80 and a sealing system 400 is provided in the recessed portion of the nest 60 or 62. Between the repositionable die members 420 and 422, the cutting and forming system 80, and the sealing system 400, a circular channel 82 is formed by the recess of the nest 60 or 62, the channel 82 being dimensioned to accept the work piece as shown in FIG. 1, with the work piece extending into the channel 82 to a predetermined depth. Associated with the nest 60 or 62 is a at the bottom of channel 82 on which the work piece is supported within the nest 60 or 62 at the predetermined position. As will be hereinafter described in more detail, the base plate is formed in association with a moveable platen 84 which is operated on by a pair of hydraulic rams 86 or other suitable mechanism. The platen assembly 84 is moveable about a drive shaft assembly 94 upwardly and downwardly to selectively position a work piece relative to the repositionable die members 420 and 422, the cutting and forming system 80, and the sealing system 400. The platen assembly 84 functions as discussed above with respect to the previous embodiments of the present invention.

Figure 20:
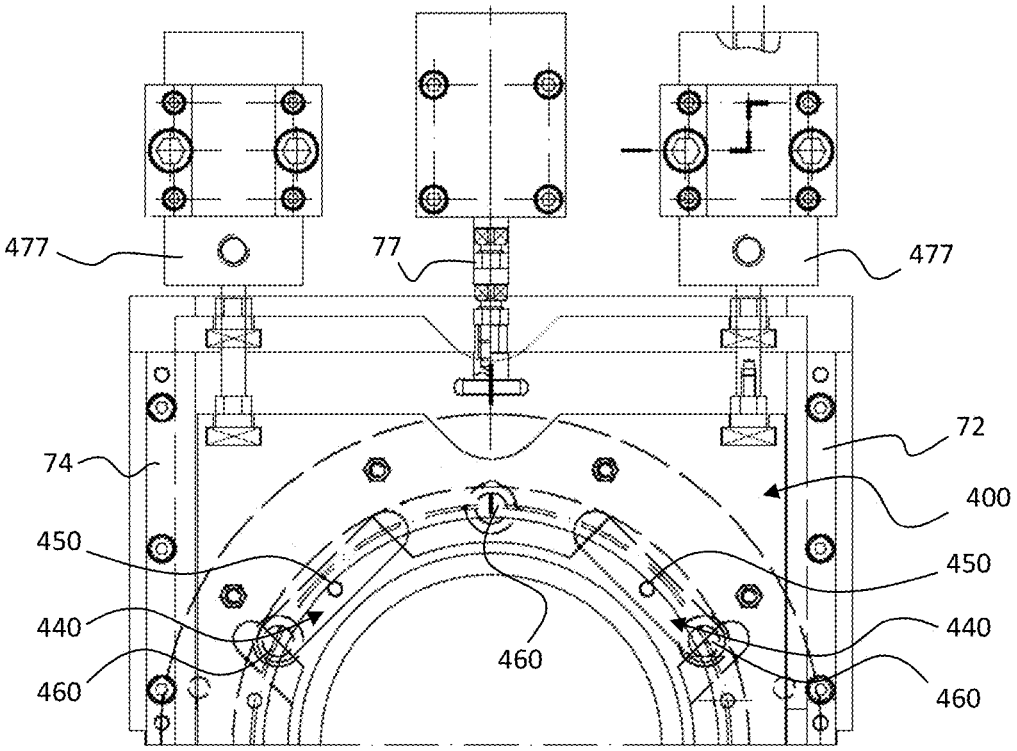
FIG. 20 shows a top view of another embodiment of the present invention.

Continuing to refer to FIGS. 20 through 26, the repositionable die members 420 and 422 supported association with the slidable plate 430 and 432 includes support from a positioning cavity 460 that allows the repositionable die member 420 and 422 to transition from one position to another or second position. The positioning cavity 460 may include a positioning device 470, which may include a spring or any other suitable device that facilities the repositionable die member 420 and 422 from a first position to a second position and vice versa. The repositionable die members 420 and 422 may include a cam 440 and a mounting rod 450 that also facilities the repositioning of the repositionable die members 420 and 422. Operation of the cam 440 with respect to the repositionable die members 420 and 422 will be discussed further at a subsequent paragraph. Additionally, the top portion of the cam 440 is slanted at an angle to receive a corresponding angled slant from the crimping slate 410 and 412. The cam 440 is attached to the repositionable die member 420 and 422 by the mounting rod 450 or by another suitable method or mechanism. Furthermore, with regard to the repositionable die members 420 and 422 and the positioning device 470, the repositionable die members 420 and 422 may be held at a particular position by one or more of the positioning devices 470. In FIG. 20, three positioning devices are shown for illustrative purposes.

Figure 21:
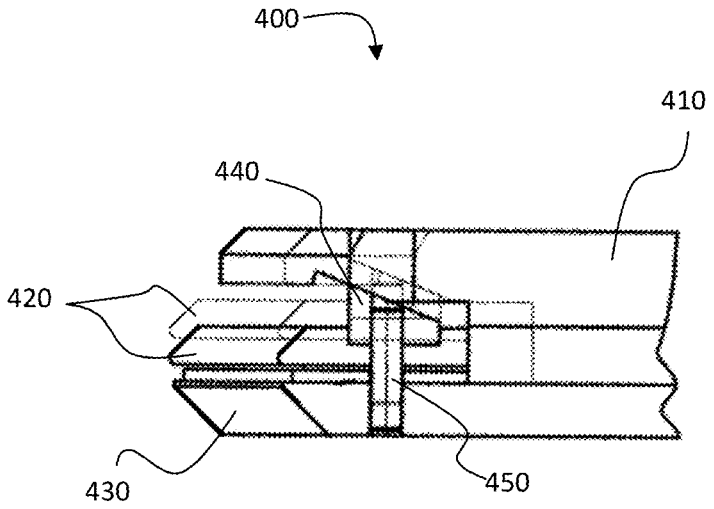
FIG. 21 shows an enlarged partial sectional view of the sealing system and the die assembly of another embodiment of the present invention.
Figure 22:
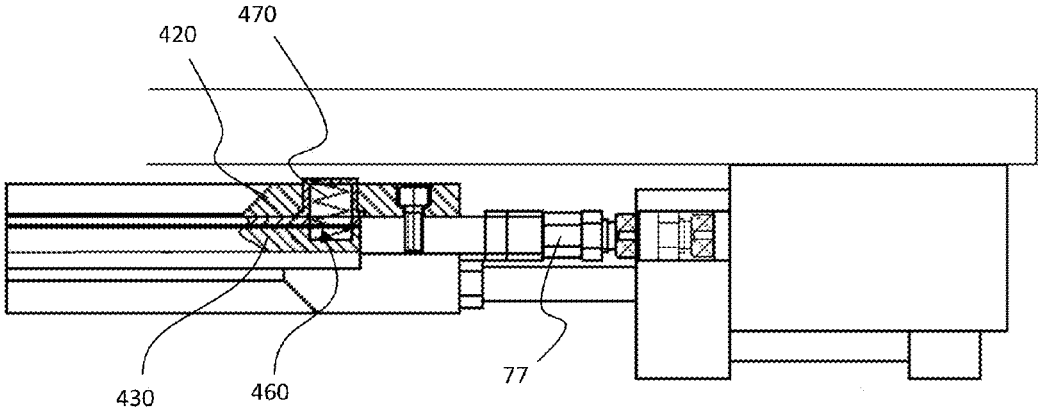
FIG. 22 shows a partial sectional view of the die assembly of another embodiment of the present invention.
Figure 23:
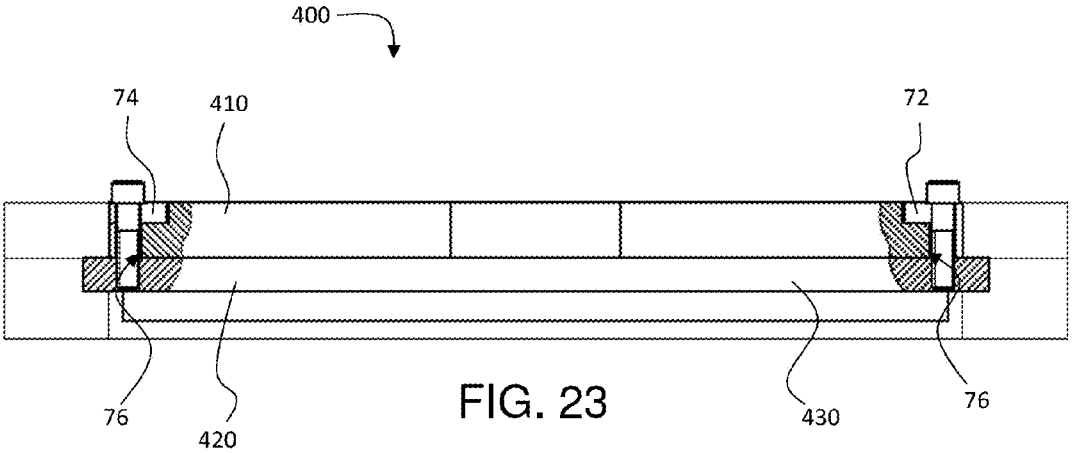
FIG. 23 shows a partial cross-sectional view of the sealing system and the die assembly of another embodiment of the present invention.
Figure 24:
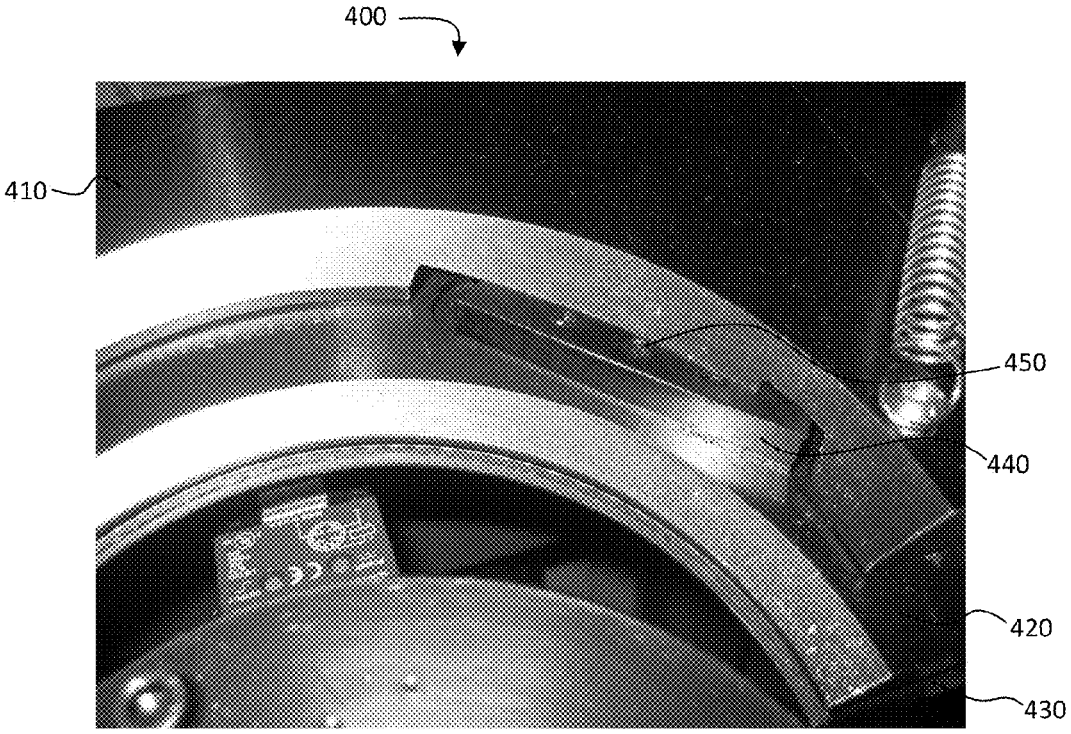
FIGS. 24-26 each show a partial perspective view of the cutting and forming assembly and of the sealing assembly of an embodiment of the present invention.
Figure 25:
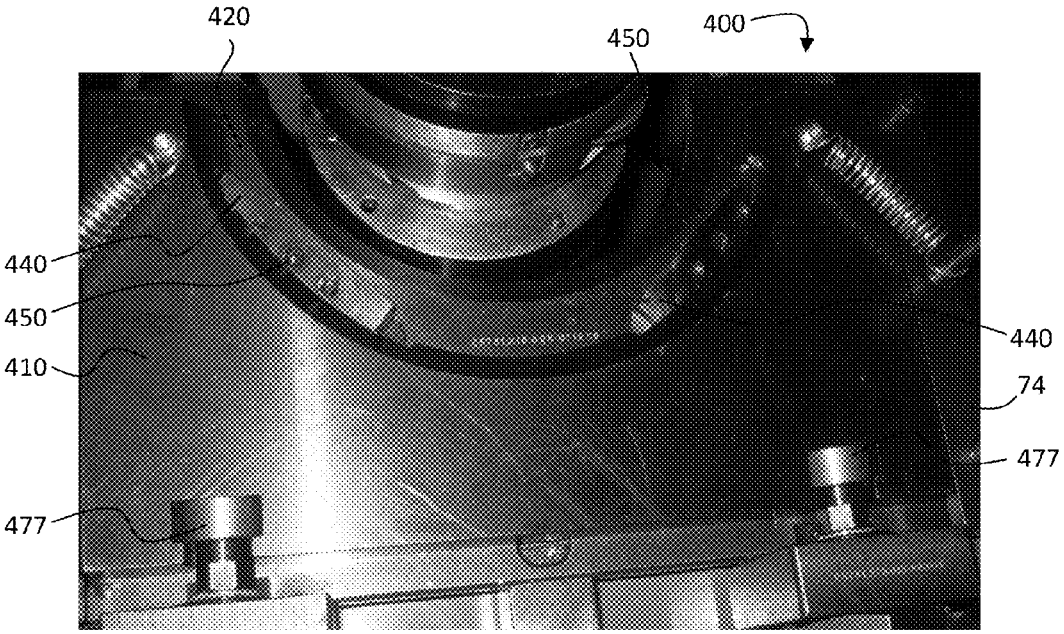
Figure 26:
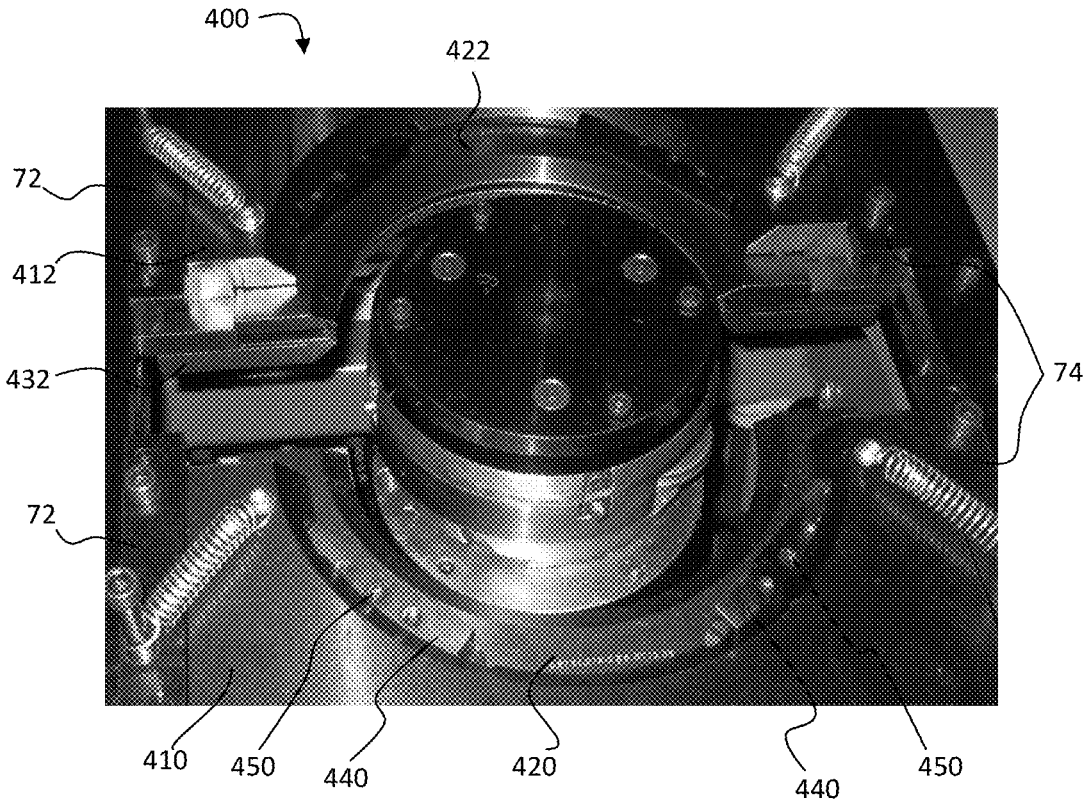

Referring to FIGS. 20, 21, and 23, each of the crimping plates 410 and 412 may be supported in association with the slidable plate 430 and 432 and the repositionable die members 420 and 422, which are supported in sliding engagement with the support blocks 72 and 74. The support blocks 72 and 74 may be adjusted relative to the slidable plates 430 and 432 and the crimping plates 410 and 412 for smooth slidable operation of the plates 430 and 432 within the channel or slot 76. Each of the crimping plates 410 and 412 may be moveable toward and away from the nest 60 or 62 by means of a secondary hydraulic ram 477 or other suitable mechanism. FIG. 20 shows two secondary hydraulic rams 477 for illustrative purposes. Additionally, the crimping plates 410 and 412 include a crimping portion that may be a cut-away section that also includes a slanted section with an angle corresponding to the angled slant of the cam 440. This corresponding angled slant allows the cam 440 to force the repositionable die members 420 and 422 in a downward direction when the crimping plates 410 and 412 move towards the nest 60 or 62, as shown in FIG. 21.

Regarding the sealing system 400, after creation of seams 24 and 26 and before retracting the repositionable die members 420 and 422 by the cutting and forming system 80, which includes the operation of the repositionable die members 420 and 422 and the slidable plate 430 and 432, the crimping plates 410 and 412 move towards the nest 60 or 62, which in turn forces the cam 440 and repositionable die members 420 and 422 in a downward manner. This results in the crimping or sealing of the gores at the seams or beads 24 and 26. Crimping or sealing of the beads 24 and 26 decreases the loss of air in the air duct system, thereby increasing the air duct system's efficiency. After sealing the seams 24 and 26 by the downward force of the cam 440 and the repositionable die members 420 and 422, the secondary hydraulic ram 477 moves the repositionable die member 420 and 422 away from the nest 60 or 62.

The present invention also allows for the replacement or substitution of a die member 64 and 66 and the a slidable plate 68 and 70 with the repositionable die member 420 and 422 and the slidable plate 430 and 432, respectively. Additionally, the slidable plate 430 and 432 and the crimping plate 410 and 412 are supported in sliding engagement with support blocks 72 and 74, as shown in FIG. 23. The slidable plate 430 and 432 and the crimping plate 410 and 412 are both supported in the channel or slot 76. The sealing system 400 may also be utilized after the completion of each of the coupled bead connection 24 and 26 between gores 14 and 16 in duct member 10. The sealing system 400 may be used in conjunction with and subsequently to the cutting and forming system 80 to effectively seal the beads 24 and 26 to create a more air tight environment.

Additionally, the repositionable die member 420 and 422, as previously described, are designed to cooperate with one another to form, when positioned adjacent to the work piece, a stationary form into which material of the work piece is pushed by the cutting and forming system 80. The repositionable die members 420 and 422 are formed to include a recess, which will cooperate with a portion of the forming system 80 to generate an outwardly directed bead in the work piece of substantial depth. Furthermore, the repositionable die members 420 and 422 perform a clamping function and a sealing function in addition to the forming function of the die. This enables both sections 12, 14, and 16 to be properly secured during and after the cutting and forming operation and this also enables sealing of the coupling beads 24 and 26.

While the above description has been presented with specific relation to a particular embodiment of the invention and methods of producing a tapered and adjustable duct member, it is to be understood that the claimed invention is not to be limited thereby and can just as easily be applied to a non-tapered work pieces. Embodiments of this invention can be directly applied in other forming machines such as those described in U.S. patent application Ser. No. 09/507,952, herein incorporated by reference. In these type of embodiments, the invention will typically be utilized in a single workstation. It will thus be seen that the objects set forth above, among those made apparent from the preceding description, are obtained. Certain changes may be made without departing from the scope of the invention and the above description is intended to be interpreted as illustrative and not limiting.

I claim:

1. An apparatus for forming and sealing an adjustable duct member for use in an air handling system, the apparatus comprising:

at least one work station adapted to accommodate a work piece, a die member positioned on said work station, the die member positioned at a predetermined location relative to said work piece positioned in said work station, a cutting and forming assembly positioned on said work station, the cutting and forming assembly cooperates with said die member to cut said work piece while said work piece is clamped by the die member to form first and second members and to form a coupling bead in said first and second members which cooperate to reconnect said first and second members together at a predetermined position, a sealing assembly comprising a slidable plate and a movable crimping plate, wherein movement of the slidable plate positions a repositionable die adjacent the coupling bead formed at the predetermined position and movement of the crimping plate causes corresponding movement of the repositionable die to engage and seal the coupling bead by crimping thereof, said work station including an insertion channel having predetermined dimensions to accommodate at least a portion of said work piece, a clamping assembly associated with said insertion channel to securely hold said work piece at said predetermined position during cutting and forming and sealing operations by the cutting and forming assembly and the sealing assembly, and a control system for control of at least said clamping assembly and said cutting and forming assembly, and movement of the slidable plate of said sealing assembly.

2. The apparatus of claim 1, wherein the sealing assembly includes a cam having an angled surface, wherein the crimping plate is moveable toward the work piece and engages the cam which in turn forces the repositionable die in a direction to crimp the coupling bead.

3. The apparatus of claim 2, wherein the crimping plate includes a cut-away section that also includes an angled section with an angle corresponding to the angled surface of the cam.

4. The apparatus of claim 3, wherein the corresponding angled surface in the crimping plate allows the cam to force the repositionable die in a direction to crimp the coupling bead when the crimping plate moves towards the work piece.

5. The apparatus of claim 1, wherein the sealing assembly includes support from a positioning cavity that allows the repositionable die to transition from one position to another position.

6. The apparatus of claim 5, wherein the positioning cavity includes a positioning device that facilities the movement of the repositionable die from said one position to another position.

7. The apparatus of claim 1, wherein the crimping plate is supported in association with the slidable plate and the repositionable die, with the slidable plate supported in sliding engagement with support members.

8. The apparatus of claim 7, wherein the support members are adjustable relative to the slidable plate.

9. The apparatus of claim 1, wherein the repositionable die comprises at least two die assemblies on opposing sides of the work piece.

10. The apparatus of claim 1, wherein the sealing assembly includes at least two slidable plates and at least two crimping plates on opposing sides of the work piece.

11. The apparatus of claim 1, wherein the clamping assembly includes at least two movable clamping members on opposing sides of the work piece.

12. The apparatus of claim 1, wherein the cutting and forming assembly is used to create first and second coupling beads in the work piece and the sealing system is utilized after the completion of each of the coupling beads to seal the coupling beads.

13. The apparatus of claim 1, wherein the repositionable die and the slidable plate and crimping plate are removable and replaceable in the apparatus separately.

14. The apparatus of claim 1, wherein the cutting and forming assembly includes a separate plate provided with an outwardly extending knife edge that cuts the work piece at a predetermined position.

15. An apparatus for forming and sealing an adjustable duct member for use in an air handling system, the apparatus comprising:

at least one work station adapted to accommodate a work piece, wherein said work station includes an insertion channel having predetermined dimensions to accommodate at least a portion of said work piece and a first die member configured to perform a clamping function for securing the work piece, a clamping assembly associated with said insertion channel to securely hold said work piece at said predetermined position, a cutting and forming assembly positioned on said work station which cuts said work piece while said work piece is clamped in the work station to form first and second members and to form a coupling bead in said first and second members which cooperate to reconnect said first and second members together at a predetermined position, a sealing assembly including a repositionable die to apply force to and seal said coupling bead in said first and second members, and a control system for at least selective control of at least said clamping assembly, said cutting and forming assembly, and said sealing assembly.

16. The apparatus of claim 15, wherein the a sealing assembly includes a slidable plate and a crimping plate, with the slidable plate and crimping plate moveable toward and away from the work piece, wherein movement of the slidable plate and crimping plate cause relative movement of the repositionable die relative to the coupling bead to crimp the coupling bead together.

17. The apparatus of claim 16, wherein the sealing assembly includes a cam wherein the crimping plate is moveable toward the work piece and engages the cam which in turn forces the cam and repositionable die in a direction to crimp the coupling bead.

18. The apparatus of claim 15, wherein the cutting and forming assembly is used to create first and second coupling beads in the work piece and the sealing system is utilized after the completion of each of the coupling beads formed by the cutting and forming assembly to seal the coupling beads.

* * * * *